US009514590B2

(12) United States Patent
Lindbichler et al.

(10) Patent No.: US 9,514,590 B2
(45) Date of Patent: Dec. 6, 2016

(54) COIN SEPARATION DEVICE

(71) Applicant: WINCOR NIXDORF INTERNATIONAL GMBH, Paderborn (DE)

(72) Inventors: Markus Lindbichler, Mitterkirchen (AT); Arno Fischer, Linz (AT); Hannes Ecklmayr, Neumarkt (AT)

(73) Assignee: WINCOR NIXDORF INTERNATIONAL GMBH (DE)

( * ) Notice: Subject to any disclaimer, the term of this patent is extended or adjusted under 35 U.S.C. 154(b) by 0 days.

(21) Appl. No.: 14/766,164

(22) PCT Filed: Jan. 22, 2014

(86) PCT No.: PCT/EP2014/051222

§ 371 (c)(1),
(2) Date: Aug. 12, 2015

(87) PCT Pub. No.: WO2014/122019

PCT Pub. Date: Oct. 14, 2014

(65) Prior Publication Data

US 2015/0371473 A1 Dec. 24, 2015

(30) Foreign Application Priority Data

Feb. 7, 2013 (EP) ..... 13154378

(51) Int. Cl.
*B07C 5/00* (2006.01)
*G07D 3/14* (2006.01)
(Continued)

(52) U.S. Cl.
CPC ..... *G07D 3/14* (2013.01); *G07D 3/128* (2013.01); *G07D 9/00* (2013.01); *G07D 9/008* (2013.01)

(58) Field of Classification Search
CPC ..... G07D 1/00; G07D 3/00; G07D 9/00; G07D 9/008; G07D 3/14; G07D 3/128; B07C 5/00; B07C 5/36; B07C 5/363
USPC ..... 453/1, 3, 55, 56; 209/615, 616, 638, 209/642
See application file for complete search history.

(56) References Cited

U.S. PATENT DOCUMENTS 3,757,918 A * 9/1973 Fougere ..... C08K 7/12 194/325
5,518,101 A 5/1996 Simizu et al.
(Continued)

FOREIGN PATENT DOCUMENTS

DE 676449 6/1939
DE 2311529 9/1973
(Continued)

OTHER PUBLICATIONS

International Search Report dated May 14, 2014. PCT/EP2014/051222 (6 pages).

*Primary Examiner* — Mark Beauchaine
(74) *Attorney, Agent, or Firm* — Gerald E. Hespos; Michael J. Porco; Matthew T. Hespos

(57) ABSTRACT

A coin separation device has a conveying device for conveying coins from an inlet container in a conveying direction along a conveying line and a checking device arranged on the conveying line for recognizing a coin that is conveyed along the conveying line. An acceleration device also is provided. The acceleration device is formed to accelerate a coin conveyed along the conveying line and recognized by the checking device in the conveying direction so that the coin is conveyed from the conveying line into a coin collection device. In this way, the coin separation device reliably conveys only coins, and not other objects from the conveying line into a coin collection device.

12 Claims, 2 Drawing Sheets

(51) Int. Cl.
*G07D 9/00* (2006.01)
*G07D 3/12* (2006.01)

(56) References Cited

U.S. PATENT DOCUMENTS 6,609,604 B1 * 8/2003 Jones ..... G07D 3/06 194/302
7,147,552 B2 12/2006 Schimpl
2005/0230219 A1 10/2005 Winau
2014/0194045 A1 * 7/2014 Fischer ..... G07D 3/14 453/3

FOREIGN PATENT DOCUMENTS

DE 2843859 4/1979
EP 2525330 11/2012
GB 2099199 12/1982

* cited by examiner

COIN SEPARATION DEVICE

CROSS-REFERENCE TO A RELATED APPLICATION

This application is a National Phase Patent Application of International Patent Application Number PCT/EP2014/051222, filed on Jan. 22, 2014, which claims priority of European Patent Application Number 13154378.7, filed on Feb. 7, 2013.

BACKGROUND

This invention relates to a coin separation device and to a method for operating a coin separation device.

Such coin separation device comprises a conveying device for conveying coins from an inlet container in a conveying direction along a conveying line and a checking device arranged on the conveying line for recognizing a coin which is conveyed along the conveying line.

In a coin separation device of this kind, which is known from U.S. Pat. No. 7,147,552 B2, there is provided a conveying device in the form of a two-strand conveyor belt which forms a conveying line along which coins are conveyed from an inlet container in an upward direction (against an action of gravity). Carriers are arranged on the conveyor belt, which take up coins from the inlet container and convey the same along the conveying line. Distributed along the conveying line different devices are provided, which are meant to ensure that only one single coin is conveyed on each carrier. In dependence on a recognition, the coins are conveyed into a coin collection device, wherein objects not recognized as coins are sorted out and returned to a user.

Such coin separation devices serve for separating coins from other objects. Downstream of a coin separation device a sorting device can be provided, which sorts coins separated by the coin separation device and passes the coins in sorted form into a collection container.

The separation device known from U.S. Pat. No. 7,147,552 B2 operates according to the so-called "vertical separation principle". In the vertical separation principle, coins are conveyed out of an inlet container, moved along a conveying line in an upward direction and supplied to a coin collection device in dependence on a coin recognition. Such coin separation devices generally are insensitive to foreign objects and can have a high recognition accuracy. By a suitable design of the conveying line only coins are to be transported along the conveying line as far as possible, while other objects remain in the inlet container. In dependence on a recognition, recognized coins then are conveyed down from the conveying line into a coin collection device for the further processing of the coins. In the coin separation device known from U.S. Pat. No. 7,147,552 B2 an electromagnetic ejector for example is provided for conveying a recognized coin from the conveying line into a coin collection device.

SUMMARY

It is the object of the present invention to provide a coin separation device and a method for operating a coin separation device, which in a reliable way convey only coins, but not other objects from the conveying line into a coin collection device.

This object is solved by a subject-matter with the features as described herein.

Accordingly, in a coin separation device an acceleration device additionally is provided, which is formed to accelerate a coin conveyed along the conveying line and recognized by the checking device in conveying direction such that the coin is conveyed from the conveying line into a coin collection device.

The present invention proceeds from the idea to provide an additional acceleration device on the conveying line, which accelerates a coin recognized as such out of the conveying movement in a conveying direction and in this way flings the recognized coin in direction of a downstream coin collection device. The acceleration device thus serves to accelerate a recognized coin out of the conveying movement, so that the coin is conveyed from the conveying line in direction of the coin collection device.

By the fact that the acceleration device accelerates a recognized coin in conveying direction it is to be understood here that the acceleration device exerts an acceleration force on the recognized coin, which with at least one direction vector component is directed in the conveying direction. The acceleration direction need not exactly correspond to the conveying direction, but for example can also be directed obliquely to the conveying direction, as long as only one direction vector component of the acceleration direction points in conveying direction (which means that the acceleration direction can be split into vector components, at least one of which points in conveying direction).

In a concrete, advantageous aspect the acceleration direction, into which the acceleration device accelerates a recognized coin, however is directed collinear to the conveying direction.

By means of the acceleration device, a recognized coin thus is accelerated out of its conveying movement, wherein the acceleration in conveying direction is such that the speed to which a recognized coin is accelerated by means of the acceleration device is greater than the conveying speed with which the coin is conveyed along the conveying line by means of the conveying device. By means of the conveying device a recognized coin thus is accelerated forwards (as seen in conveying direction) out of its conveying movement and in this way conveyed in direction of a downstream coin collection device.

By means of the acceleration device a recognized coin thus is conveyed from the conveying line towards the coin collection device. This provides for reliably conveying coins recognized as such towards a coin collection device and can reliably ensure that only coins, but not other objects get into the coin collection device.

Advantageously, the conveying line has a first end and a second end, wherein the inlet container is arranged in the region of the first end and the acceleration device is arranged in the region of the second end. The acceleration device then preferably is formed to convey a recognized coin past the second end into the coin collection device beyond the second end. By means of the acceleration device a recognized coin thus is accelerated past the second end and in this way moved from the conveying line in direction of the coin collection device, wherein the coin collection device is designed in a suitable way to pick up the coin.

In an advantageous aspect, the coin collection device—as seen along the conveying direction—, is arranged at a distance to the second end of the conveying line. The coin collection device thus does not directly adjoin the conveying line, but is away from the second end of the conveying line by a predetermined distance. When a coin is accelerated by means of the acceleration device, it is flung into the coin collection device by overcoming the distance past the second end of the conveying line, wherein the acceleration force effected by the acceleration device is dimensioned such that by overcoming the distance a recognized coin also reaches the coin collection device and thus reliably gets into the coin collection device. When a coin or another object, on the other hand, is not or not sufficiently accelerated, the coin or the object does not get into the coin collection device, but for example is conveyed through an opening formed by the distance between the second end of the conveying line and the coin collection device and in this way gets into a return device different from the coin collection device. Non-recognized coins—for example counterfeit money or coins of another currency or such coins which no longer can be taken up by the coin collection device (for example because the coin collection device or individual containers of the coin collection device are filled already)—or other foreign objects thus are returned to a user and not processed in the downstream coin collection device.

The acceleration device for example can include a step motor and an acceleration element driven by the step motor, e.g. a rotary wheel, for accelerating a coin. An acceleration element formed as rotary wheel for example can be formed as a paddle wheel rotatable about an axis of rotation with one or more paddles for acting on a coin to be accelerated. In operation of the coin separation device the step motor drives the acceleration element—in dependence on the recognition of a coin by the checking device—, in that for example the paddle wheel is rotated and by action of a paddle on the coin to be accelerated the coin is accelerated out of its conveying movement. The step motor is actuated incrementally in dependence on the recognition by the checking device and thus only moves the acceleration element when the checking device generates a suitable control signal which indicates the recognition of a coin. The acceleration thus is effected selectively: Only such coins are accelerated which have been recognized and are to be supplied to the coin collection device.

In the case of the proper arrangement and use of the coin separation device the conveying direction with at least one direction vector component is directed against a gravity direction. The coin separation device thus operates according to the vertical separation principle, in that coins are conveyed from the inlet container in an upward direction along the conveying line. The conveying direction need not be directed exactly vertically against the gravity direction (i.e. against the direction in which gravity acts), but advantageously points obliquely to the gravity direction such that a direction vector component of the conveying direction is directed against the gravity direction).

In an advantageous aspect, the conveying device includes a conveyor belt with two synchronously moved conveying strands extending parallel to each other along the conveying direction. The conveying strands each can be realized by a circulating conveyor belt, wherein the conveying strands are moved synchronously and thus jointly convey coins out of the inlet container. On each conveying strand at least one carrier therefore is arranged, wherein a carrier of the one conveying strand and a carrier of the other conveying strand form a carrier pair for carrying along one coin each.

The acceleration element of the acceleration device advantageously is placed relative to the conveying strands such that—as seen transversely to the conveying direction—it is arranged between the conveying strands. For accelerating a coin, the acceleration element thus is moved through between the carriers of the carrier pair, on which the coin to be accelerated is being guided, in this way acts on the coin and flings the same in direction of the coin collection device. Due to the fact that the acceleration element is moved through between the carriers, the acceleration element can act on the coin to be accelerated in a defined way and accelerate the same relative to the conveying strands, so that the coin is conveyed from the conveying line in direction of the coin collection device.

The coin collection device serves for picking up the coins accelerated away from the conveying line. The coin collection device advantageously can include a sorting device for sorting the coins conveyed into the coin collection device, which in particular is formed to pass each coin, depending on a coin type, into a coin collection container associated to the coin type. The coin type for example can already be recognized by the checking device of the conveying device, so that the coin type of the coin is fixed already when the same is conveyed into the coin collection device by means of the acceleration device. Depending on the coin type, the coin then is processed and supplied to an associated coin collection container, so that for example a 1-Euro coin gets into a collection container for 1-Euro coins.

The sorting device for example can include an adjustable sorting funnel which at an inlet takes up the coin to be sorted and with an outlet can be moved towards an entrance of a collection container associated to the coin type of the coin to be sorted, so that by means of the sorting funnel the coin is supplied to the associated collection container.

In addition, the coin collection device can include a control device, for example in the form of a simple light barrier or in the form of a more expensive checking device for recognizing a coin including its coin type. The control device (at least) is formed to detect the presence of a coin in the coin collection device, in order to for example verify in this way that a coin recognized by the checking device of the conveying device and accelerated towards the coin collection device by the acceleration device really has come into the coin collection device. When the control device for example finds that no coin is detected within a predetermined period, although after recognition by the checking device of the conveying device and after acceleration by the acceleration device a coin should have come into the coin collection device, this for example indicates that a malfunction exists on the part of the conveying device, for example because the acceleration has failed and the recognized coin thus has not reached the coin collection device. In this case, the coin is not posted. For the further processing it rather is registered that the coin has not come into the coin collection device.

Due to the fact that the control device is arranged at a predetermined place, for example at a channel of the coin collection device, it can also be determined by the control device of the coin collection device when the coin supplied to the coin collection device has reached the place of the control device. In dependence on a detection signal of the control device a downstream sorting device thus can also be controlled, in that for example in dependence on a detection signal of the control device an adjusting movement of the sorting device is triggered for supplying the coin towards an associated collection container.

The channel of the coin collection device, into which a coin is conveyed out of its conveying movement, advantageously is formed curved in particular with an outer wall facing away from the conveying device in a plane defined by the conveying direction and the gravity direction. In this way, the channel in particular with its outer wall simulates the trajectory (parabolic due to the acting gravity) of a coin accelerated and conveyed into the coin collection device, which results in that a coin flung into the channel slidingly gets in contact with the outer wall of the channel and slidingly is guided along the outer wall, so that a defined movement of the coin along the channel is obtained.

The object furthermore is solved by a method for operating a coin separation device. The coin separation device comprises a conveying device for conveying coins from an inlet container in a conveying direction along a conveying line and a checking device arranged on the conveying line for recognizing a coin which is conveyed along the conveying line. It is provided that an acceleration device accelerates a coin conveyed along the conveying line and recognized by the checking device in conveying direction such that the coin is conveyed from the conveying line into a coin collection device.

The advantages and advantageous aspects described above for the coin separation device analogously also apply to the method for operating the coin separation device. Preferably, the method serves for operating a coin separation device as described above.

Advantageously, the acceleration device is actuated in dependence on a control signal generated by the checking device for accelerating a coin conveyed on the conveying line. The acceleration device thus is selectively actuated in dependence on a recognition of a coin by the checking device, wherein for this purpose for example a step motor of the acceleration device can be energized in a selective way, in order to incrementally drive a suitable acceleration element, for example a paddle wheel, for accelerating a coin.

BRIEF DESCRIPTION OF THE DRAWINGS

The idea underlying the invention will be explained in detail below with reference to the exemplary embodiments illustrated in the Figures.

DETAILED DESCRIPTION

Figure 1:
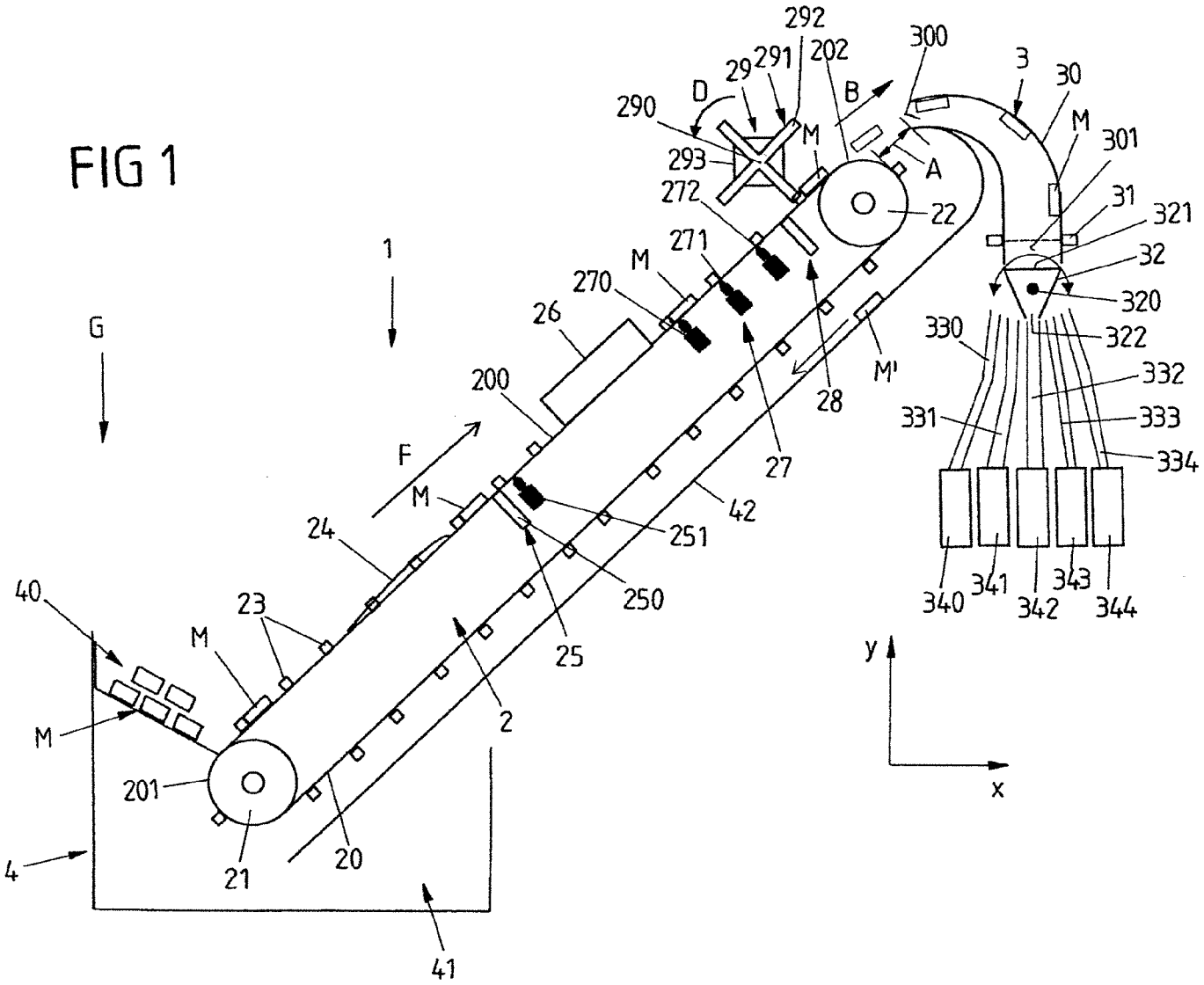
FIG. 1 shows a schematic view of a coin separation device with a conveying device and an acceleration device arranged on the conveying device for accelerating a coin out of its conveying movement, as seen from the side.
Figure 2:
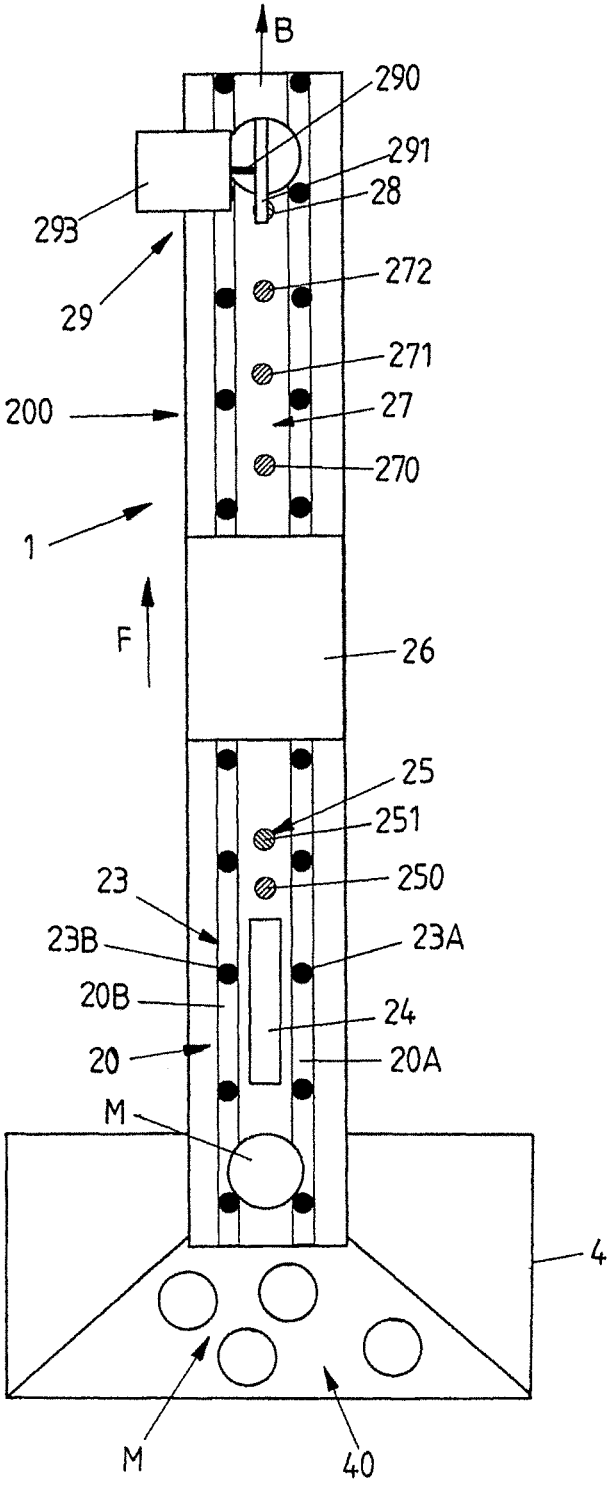
FIG. 2 shows a view of the conveying device and the acceleration device according to FIG. 1, as seen in a top view from above.

FIGS. 1 and 2 show an exemplary embodiment of a coin separation device 1 which includes a conveying device 2 for conveying coins from an inlet container 40 along a conveying line 200 towards a coin collection device 3.

The conveying device 2 is formed as conveyor belt with two synchronously driven conveying strands 20A, 20B extending parallel to each other. Each conveying strand 20A, 20B is realized by a circulating conveyor belt, wherein the conveying strands 20A, 20B are guided on identical deflection elements 21, 22 in the form of deflection pulleys and are synchronously driven with the same speed for an equidirectional movement.

The conveyor belt 20 formed by the conveying strands 20A, 20B serves to convey coins M from the inlet container 40 in a conveying direction F along the conveying line 200. The conveying device 2 here realizes the so-called vertical separation principle, in that the conveying direction F with one direction vector component is directed against the gravity direction G (i.e. the conveying direction F can be split into vector components, one of which is directed against the gravity direction G). Coins M thus are conveyed out of the inlet container 40 along the conveying direction F obliquely to the top (i.e. upwards) with respect to the gravity direction G, wherein for this purpose carrier pairs 23 are formed at the conveying strands 20A, 20B, which each are realized by a first carrier 23A arranged on the one conveying strand 20A and a second carrier 23B arranged on the other conveying strand 20B.

For conveying a coin M out of the inlet container 40, a carrier pair 23 is moved through the inlet container 40 and in this way picks up a coin M, which—as shown in FIGS. 1 and 2—comes to lie at the conveying strands 20A, 20B and is held between the carriers 23A, 23B of the carrier pair 23. By moving the conveying strands 20A, 20B in the conveying direction F, the coin M now is moved along the conveying line 200 in the conveying direction F, wherein the movement of the conveying strands 20A, 20B is effected continuously and thus coins M successively are taken up from the inlet container 40 and conveyed along the conveying line 200.

When taking up a coin M from the inlet container 40, it can occur that several coins M come to lie at a carrier pair 23, for example in that two coins lie one above the other or in that one coin M at a carrier pair 23 pushes a further coin M ahead of itself.

At the conveying line 200, first a ramp 24 and then subsequently in conveying direction F a dropping device 25 are arranged, which are meant to ensure that on each carrier pair 23 only exactly one coin M is conveyed. When a coin M conveyed on a carrier pair 23 reaches the ramp 24, it runs up onto the same and thus is offset (slightly) vertically to the conveying direction F on the associated carrier pair 23. In this way, the coin M is lifted from the conveying strands 20A, 20B, which leads to the fact that a second coin M arranged on the coin M slides from the carriers 23A, 23B of the carrier pair 23 and thus drops from the conveyor belt 20.

After the ramp 24 the coin M gets to the dropping device 25, which includes a for example inductively formed sensor 250 and a for example electromagnetically formed dropper 251 arranged downstream in conveying direction F. When it is recognized by means of the (inductive) sensor 250 that a coin M on a carrier pair 23 pushes a further coin M ahead of itself, the dropper 251 is actuated correspondingly and the further coin is dropped.

After the ramp 24 and the dropping device 25 it thus is ensured that on a carrier pair 23 only exactly one coin M is conveyed. The coin M then gets to a checking device 26 arranged on the conveying line 200, which serves to detect a coin, i.e. to recognize whether it is a coin M to be processed or another object, for example a foreign object or a coin which cannot be processed (e.g. because it has another currency). Depending on the recognition which for example can be made with reference to a diameter recognition, a weight recognition or also an optical pattern recognition, a control signal is generated, which serves to actuate a downstream acceleration device 29, as will yet be explained below.

After passing through the checking device 26, a coin M gets to a dropping device 27, which includes droppers 270, 271, 272 for selectively dropping the coin M from the conveyor belt 20. Two of the droppers 270, 271, 271 serve to drop coins M with extreme properties (e.g. extremely lightweight or extremely heavy coins M or coins M with extraordinary shape, e.g. square coins which cannot be accelerated optimally by means of the downstream acceleration device 29). A third one of the droppers 270, 271, 272 serves to selectively drop a coin M, when the coin M has been recognized and verified, but it has then been found that the downstream coin collection device 3 is not able to take up and process the coin M, for example because a container associated to the coin M is full and thus is not able to take up any further coins M.

After passing the dropping device 27 with the droppers 270, 271, 272 a coin M guided on a carrier pair 23—if it has not been dropped yet, but has been recognized and verified by the checking device 26—will be supplied to the coin collection device 3 for further processing. For this purpose the acceleration device 29 is used, which is arranged in a firm positional relation to the conveyor belt 20 of the conveying device 2 and includes a step motor 293 which via an axis of rotation 290 includes an acceleration element 291 in the form of a paddle wheel with a number of individual paddles 292.

The acceleration device 29 is arranged at a second end 202 of the conveying line 200 of the conveying device 2 (at an opposite first end 201 the conveying device 2 takes up the coins M from the inlet container 40). The acceleration element 29 is rotatable about the axis of rotation 290 and—as seen in a transverse direction transversely to the conveying direction F—is arranged between the conveying strands 20A, 20B and thus spatially between the carriers 23A, 23B arranged thereon (see FIG. 2). The acceleration element 291 thus can be moved through between the carriers 23A, 23B of a carrier pair 23, in order to in this way act on a coin M arranged on a carrier pair 23 with one of its paddles 292.

In operation, the acceleration element 291 in the form of the paddle wheel incrementally is put into a rotary movement in a direction of rotation D about the axis of rotation 290 by means of the step motor 293. The actuation of the step motor 293 is effected in dependence on a control signal generated by the checking device 26, which indicates the correct recognition of a coin M and correspondingly controls the step motor 293 for conveying the coin M into the collection device 3. With a corresponding actuation, the step motor 293 thus drives the acceleration element 291 in the form of the paddle wheel in the direction of rotation D, so that a paddle 292 strikes against the coin M to be accelerated and accelerates the same in an acceleration direction B approximately equidirectional with the conveying direction F.

By means of the acceleration device 29 a coin M to be conveyed into the coin collection device 3 is accelerated out of the conveying movement along the conveying line 200 and in this way flung into an entrance 300 of a channel 30 of the coin collection device 3. The acceleration is effected out of the conveying movement and thus at least approximately in the conveying direction F due to the fact that the coin M is accelerated in conveying direction F to a speed which exceeds the conveying speed of the conveying device 2 along the conveying line 200 (effected by the conveying movement of the conveyor belt 20 with its conveying strands 20A, 20B). The coin M thus is accelerated past the second end 202 of the conveying line 200 and gets into the coin collection device 3.

The coin collection device 3 is spaced from the second end 202 of the conveying line 200 with a distance A. The acceleration of the coin M is such that the accelerated coin M can overcome the distance A and thus gets into the entrance 300 of the channel 30.

The channel 30 is formed curved in the plane defined by the conveying direction F and the gravity direction G. In particular with its outer wall facing away from the conveying device 2 the channel 30 simulates the trajectory (parabolic due to the acting gravity) of a coin M accelerated and conveyed into the coin collection device 3. The consequence is that a coin M flung into the channel 30 slidingly gets in contact with the outer wall of the channel 30 and slidingly is guided along the outer wall, so that a defined movement of the coin M along the channel 30 is obtained, without the coin M e.g. starting to wobble.

An object M' (for example a non-conforming object or a coin which should not get into the coin collection device 3) which at the second end 202 of the conveying line 200 still is on the conveyor belt 20 and thus has passed all devices 24, 25, 26, 27, 28 along the conveying line 200 and neither has been accelerated by the acceleration device 29, is conveyed past the second end 202 of the conveying line 200, but drops through the opening created by the distance A between the second end 202 of the conveying line 200 and the entrance 300 of the coin collection device 3 onto a chute 42 which conveys the object M' (see FIG. 1) back into a collection container 41 of a return device 4 and thus returns it to an operator.

Downstream of the dropping device 27 in conveying direction F along the conveying line 200 a control device 28 is arranged, which serves to check the correct ejection of the coin M—if the same should have been effected—at the dropping device 27. The control device 28 for example is designed as inductive sensor which checks whether a metallic coin M, which should have been dropped by the dropping device 27, actually has been dropped and for this purpose inductively generates a signal, when the coin M possibly passes the same.

At its entrance 300 the coin collection device 3 picks up a coin M flung from the conveying line 200 towards the coin collection device 3 by means of the acceleration device 29 and passes the coin M via the channel 30 towards a sorting device 32 in the form of a sorting funnel pivotable about a swivel axis 320. Before the coin M reaches the sorting device 32, it passes a control device 31 which serves to detect the coin M, in order to verify that the coin M actually has come into the coin collection device 3. In addition, when the coin M passes the control device 31 (which for example can be formed as light barrier), a position signal can be generated, which can be used for triggering an adjusting movement of the sorting device 32, in order to guide the coin M into a coin collection channel 330-334 and a coin collection container 340-344 downstream of the coin collection channel 330-334 for suitable sorting.

When reaching the sorting device 32, the coin M gets into a funnel-shaped inlet 321 of the sorting device 32 and via an outlet 322 is guided to the associated coin collection channel 330-334 and above the same to the associated coin collection container 340-344.

For example one coin collection container 340-344 can be associated to each coin type. A 1-Euro coin for example can be passed into a coin collection container 340-344, in which 1-Euro coins are collected. The same applies for coins of other coin types.

The idea underlying the invention is not limited to the exemplary embodiments described above, but in principle can also be realized in completely different embodiments.

In particular, the acceleration direction in which the acceleration device accelerates a coin to be accelerated is not necessarily directed exactly collinear to the conveying direction. It only is essential that a direction vector component of the acceleration direction points in the conveying direction F, so that a coin is accelerated (also) in conveying direction. The acceleration direction for example also can be directed obliquely to the conveying direction.

The acceleration device in principle can be designed in any way and need not necessarily use a paddle wheel. For example, the acceleration also can be effected in a completely different way, for example by means of compressed air or by an electromagnetic ejection device which effects an acceleration (also) in conveying direction. In principle, there can be used all acceleration devices which can effect an acceleration out of the conveying movement.

LIST OF REFERENCE NUMERALS

1 coin separation device
2 conveying device
20 conveyor belt
200 conveying line
201, 202 end
20A, 20B conveying strand
21, 22 deflection element
23 carrier pair
23A, 23B carrier
24 ramp
25 dropping device
250 (inductive) sensor
251 dropper
26 checking device
27 dropping device
270, 271, 272 dropper
28 control device
29 acceleration device
290 axis of rotation
291 acceleration element (paddle wheel)
292 paddle
293 step motor
3 coin collection device
30 channel
300 entrance
301 exit
31 control device
32 sorting device
320 swivel axis
321 inlet
322 outlet
330-334 coin collection channel
340-344 coin collection container
4 return device
40 inlet container
41 collection container
42 chute
A distance
B acceleration direction
D direction of rotation
F conveying direction
G gravity direction
M coin
M' object
X horizontal direction
Y vertical direction

The invention claimed is:

1. A coin separation device, comprising a conveying device having opposite first and second ends and being configured for conveying coins in a conveying direction along a conveying line from an inlet container in proximity to the first end of the conveying device, a checking device arranged on the conveying line for recognizing a coin conveyed along the conveying line, and an acceleration device in proximity to the second end of the conveying device and formed to accelerate a coin conveyed along the conveying line and recognized by the checking device in the conveying direction such that the coin is conveyed from the conveying line into a coin collection device arranged at a distance from the second end of the conveying line as seen along the conveying direction, the accelerating device being configured so that the coin accelerated by the acceleration device is conveyed past the second end of the conveying line into the coin collection device by overcoming the distance, but without acceleration the coin is conveyed into a return device different from the coin collection device.

2. The coin separation device according to claim 1, wherein the acceleration device is formed to convey a recognized coin past the second end into the coin collection device beyond the second end.

3. The coin separation device according to claim 1, wherein, in a case of proper arrangement and use of the coin separation device the conveying direction with at least one direction vector component is directed against a gravity direction.

4. The coin separation device according to claim 1, wherein the conveying device includes a conveyor belt with two synchronously moved conveying strands extending parallel to each other along the conveying direction, wherein on each of the conveying strands at least one carrier is arranged and a carrier of the one conveying strand and a carrier of the other conveying strand form a carrier pair for carrying along a coin.

5. The coin separation device according to claim 1, wherein the coin collection device includes a sorting device for sorting the coins conveyed into the coin collection device.

6. The coin separation device according to claim 5, wherein the sorting device is formed to pass each coin depending on a coin type into a coin collection container associated to the coin type.

7. The coin separation device according to claim 5, wherein the coin collection device includes a control device which is formed to detect a coin in the coin collection device.

8. A coin separation device, comprising:

a conveying device for conveying coins from an inlet container in a conveying direction along a conveying line, a checking device arranged on the conveying line for recognizing a coin conveyed along the conveying line, and an acceleration device that is formed to accelerate a coin conveyed along the conveying line and recognized by the checking device in the conveying direction such that the coin is conveyed from the conveying line into a coin collection device, wherein the acceleration device includes a step motor and an acceleration element driven by the step motor for accelerating a coin.

9. The coin separation device according to claim 8, wherein the acceleration element is formed by a paddle wheel rotatable about an axis of rotation with paddles for acting on a coin.

10. A coin separation device, comprising:

a conveying device for conveying coins from an inlet container in a conveying direction along a conveying line, the conveying device including a conveyor belt with two synchronously moved conveying strands extending parallel to each other along the conveying direction, at least one carrier being arranged on each of the conveying strands and a carrier of the one conveying strand and a carrier of the other conveying strand form a carrier pair for carrying along a coin, a checking device arranged on the conveying line for recognizing a coin conveyed along the conveying line, and an acceleration device having an acceleration element that is formed to accelerate a coin conveyed along the conveying line and recognized by the checking device in the conveying direction such that the coin is conveyed from the conveying line into a coin collection device, wherein the acceleration element of the acceleration device, as seen transversely to the conveying direction, is arranged between the conveying strands for moving the acceleration element in the conveying direction through between the carriers of the carrier pair.

11. A method for operating a coin separation device, that comprises conveying coins from an inlet container in a conveying direction along a conveying line, operating a checking device arranged on the conveying line for recognizing at least a selected one of the coins conveyed along the conveying line, and actuating an acceleration device when one of the coins conveyed along the conveying line has been recognized by the checking device so that the recognized coin is accelerated sufficiently in the conveying direction to be conveyed from the conveying line into a coin collection device.

12. The method according to claim 11, wherein the step of operating the checking device comprises generating a control signal when the checking device recognizes the selected one of the coins and the step of actuating the acceleration device is carried in dependence on the control signal generated by the checking device for accelerating the coin conveyed on the conveying line.

* * * * *